US008464975B2

(12) United States Patent
Bartesaghi et al.

(10) Patent No.: US 8,464,975 B2
(45) Date of Patent: Jun. 18, 2013

(54) NON-STOP UNWINDING DEVICE WITH LIMITED BULK FOR ROLLS OF WEB-LIKE MATERIAL

(75) Inventors: Angelo Bartesaghi, Lecco (IT); Roberto Perego, Moggio (IT)

(73) Assignee: OMET S.r.l., Lecco (IT)

( * ) Notice: Subject to any disclaimer, the term of this patent is extended or adjusted under 35 U.S.C. 154(b) by 470 days.

(21) Appl. No.: 12/452,749

(22) PCT Filed: Jul. 23, 2008

(86) PCT No.: PCT/IB2008/002019
§ 371 (c)(1),
(2), (4) Date: Aug. 2, 2010

(87) PCT Pub. No.: WO2009/013615
PCT Pub. Date: Jan. 29, 2009

(65) Prior Publication Data

US 2010/0288867 A1 Nov. 18, 2010

(30) Foreign Application Priority Data

Jul. 25, 2007 (IT) ..... MI2007A1497

(51) Int. Cl.
*B65H 19/00* (2006.01)

(52) U.S. Cl.
USPC ..... 242/559; 242/559.4; 242/615.12

(58) Field of Classification Search
USPC ..... 242/559, 559.2–559.4, 563, 615.11, 242/615.12
See application file for complete search history.

(56) References Cited

U.S. PATENT DOCUMENTS

| | | | | |
|---|---|---|---|---|
| 4,196,662 | A | 4/1980 | Hsu | |
| 4,386,988 | A | 6/1983 | Kontz | |
| 4,880,178 | A * | 11/1989 | Goulette | 242/554.4 |
| 5,092,573 | A * | 3/1992 | Abreu | 270/52.08 |
| 6,142,206 | A | 11/2000 | Ryan | |
| 6,679,451 | B1 * | 1/2004 | Biagiotti | 242/559 |
| 6,796,524 | B2 * | 9/2004 | Pollock et al. | 242/615.12 |
| 2003/0089816 | A1 * | 5/2003 | Hanson et al. | 242/559 |

FOREIGN PATENT DOCUMENTS

GB 2 073 717 10/1981

OTHER PUBLICATIONS

PCT Search Report dated Jan. 16, 2009.

* cited by examiner

*Primary Examiner* — Sang Kim
(74) *Attorney, Agent, or Firm* — Hedman & Costigan, P.C.; James V. Costigan

(57) ABSTRACT

An unwinding device (10) is described for unwinding rolls (12, 14) of one-ply or two-ply web-like material (24). The device (10) comprises: a support group for sustaining a first roll (12) and a second roll (14), the support group being composed of a support pin (16) for each roll (12, 14), the support pins (16) being bound on two opposite sides of a vertical column (18) made integral with the base (20) of the unwinding device (10); an unwinding mechanism (22) for each roll (12, 14), adapted to unwind the web-like material (24) from the rolls (12, 14); a joining mechanism (26), adapted to join specific web-like material portions (24) together that respectively come from the first roll (12) and from the second roll (14). One of the support pins (16) is bound to the vertical column (18) at a height ($H_1$), measured with respect to the base (20), that is different from the height ($H_2$) of the second support pin (16) bound on the opposite side of the vertical column (18), so as to limit the thickness of the vertical column (18) along with the width of the unwinding device (10) as much as possible.

9 Claims, 13 Drawing Sheets

NON-STOP UNWINDING DEVICE WITH LIMITED BULK FOR ROLLS OF WEB-LIKE MATERIAL

The present invention refers to a non-stop unwinding device with limited bulk for unwinding rolls of web-like material.

In numerous industrial applications, for example in the production of paper manufactured goods such as napkins, toilet paper or other items, one is required to feed a generic production line with a web-like material normally obtained by means of unwinding of one roll or several rolls arranged in parallel.

Specific machinery are then available that are capable of supporting one or more large diameter rolls and carrying out their continuous, high-speed unwinding, so as to make the web-like material available for subsequent processing. Normally, such unwinding machinery are also capable of automatically carrying out the joining of webs coming from different rolls, by means of pasting between the end of the web exiting from the roll upon completed unwinding and the end of the web loaded onto the next roll to be unwound, so as to be able to send a continuous and uniform web to the subsequent transformation or processing lines.

On some continuous unwinding devices of traditional type, the rolls of web-like material are arranged in line with respect to each other, with the joining head of the machine placed between the rolls themselves. A similar solution, however, leads to a considerable bulk of the unwinding device in the longitudinal direction.

Particular unwinding devices were then made in which the web-like material rolls are arranged flanking, mounted on substantially horizontal support pins bound to a rotatable vertical arm. When the web present on the unwinding roll is close to finishing, the machine is stopped and the vertical arm is made to rotate 180° in order to present the new roll to the unwinding mechanism. After the ends of the webs being processed are joined, the unwinding machine is then reactivated.

However, the drawback of this type of unwinding device, in addition to requiring a rotating vertical support for flanking rolls, with consequent structural complications, is that of increasing the transverse bulk of the unwinding device itself. This problem should not be underestimated, especially when the unwinding device is installed in a factory upstream of pre-existing equipment for processing the continuous web, which often do not have adequate space around them.

The object of the present invention is therefore to provide a non-stop unwinding device for unwinding rolls of web-like material in which the bulk of the device itself is limited as much as possible, while high functioning reliability is maintained.

Another object of the invention is that of making a non-stop unwinding device with limited bulk for rolls of web-like material in which the joining operation of the ends of the webs coming from the finishing roll and from the next roll is facilitated and rendered as automated as possible.

Still another object of the invention is that of making a non-stop unwinding device with limited bulk for rolls of web-like material that is simple to utilise and economical to make.

These objects according to the present invention are achieved by providing a non-stop unwinding device with limited bulk for rolls of web-like material as set forth in claim 1.

Further characteristics of the invention are highlighted in the subsequent claims.

The characteristics and advantages of a non-stop unwinding device with limited bulk for rolls of web-like material according to the present invention will be more evident from the following exemplifying and non-limiting description, referred to the attached schematic drawings in which.

Figure 2:
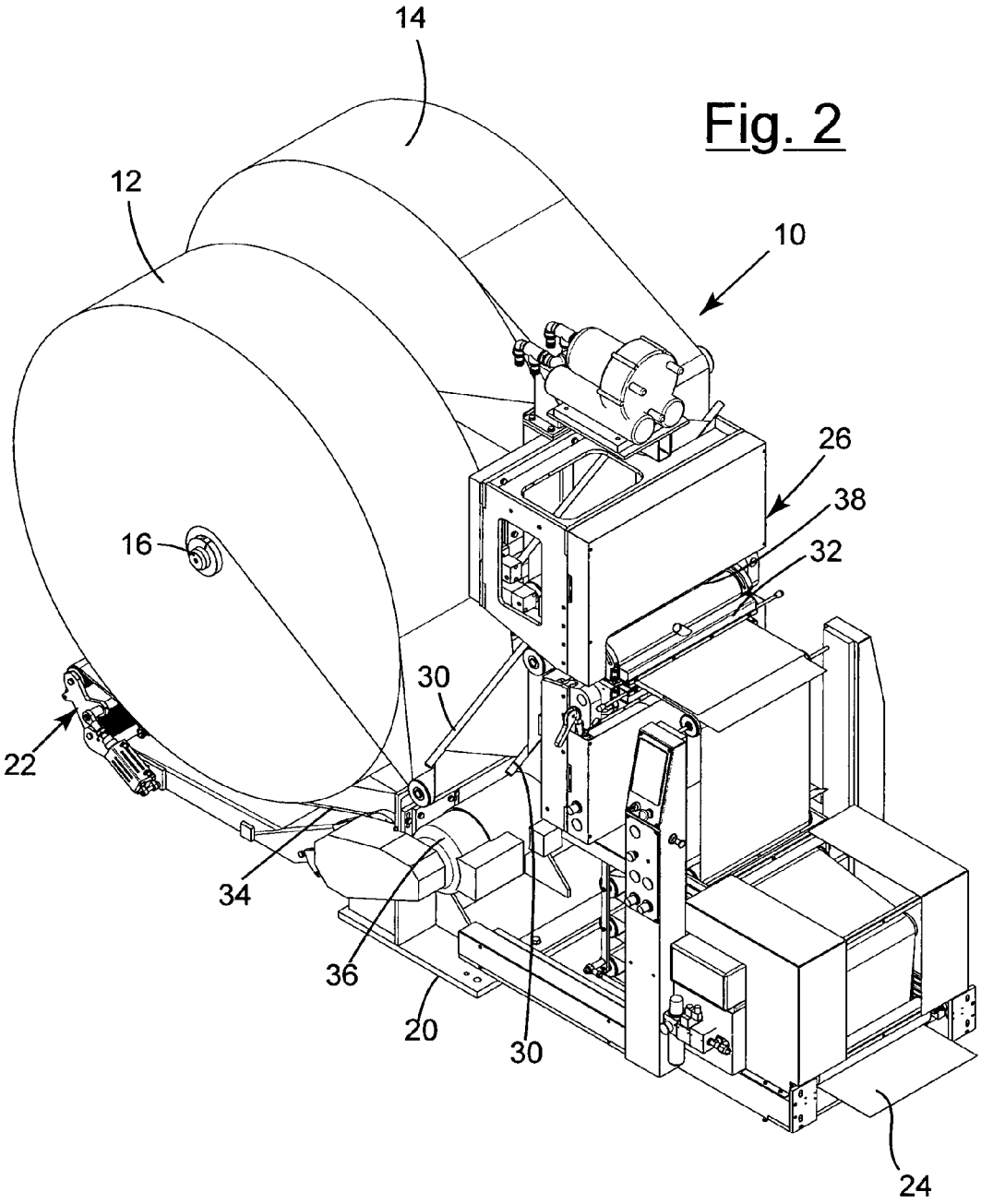
FIG. 2 is a perspective view, from the front side, of a first embodiment of an unwinding device with limited bulk for rolls of web-like material according to the present invention.
Figure 3:
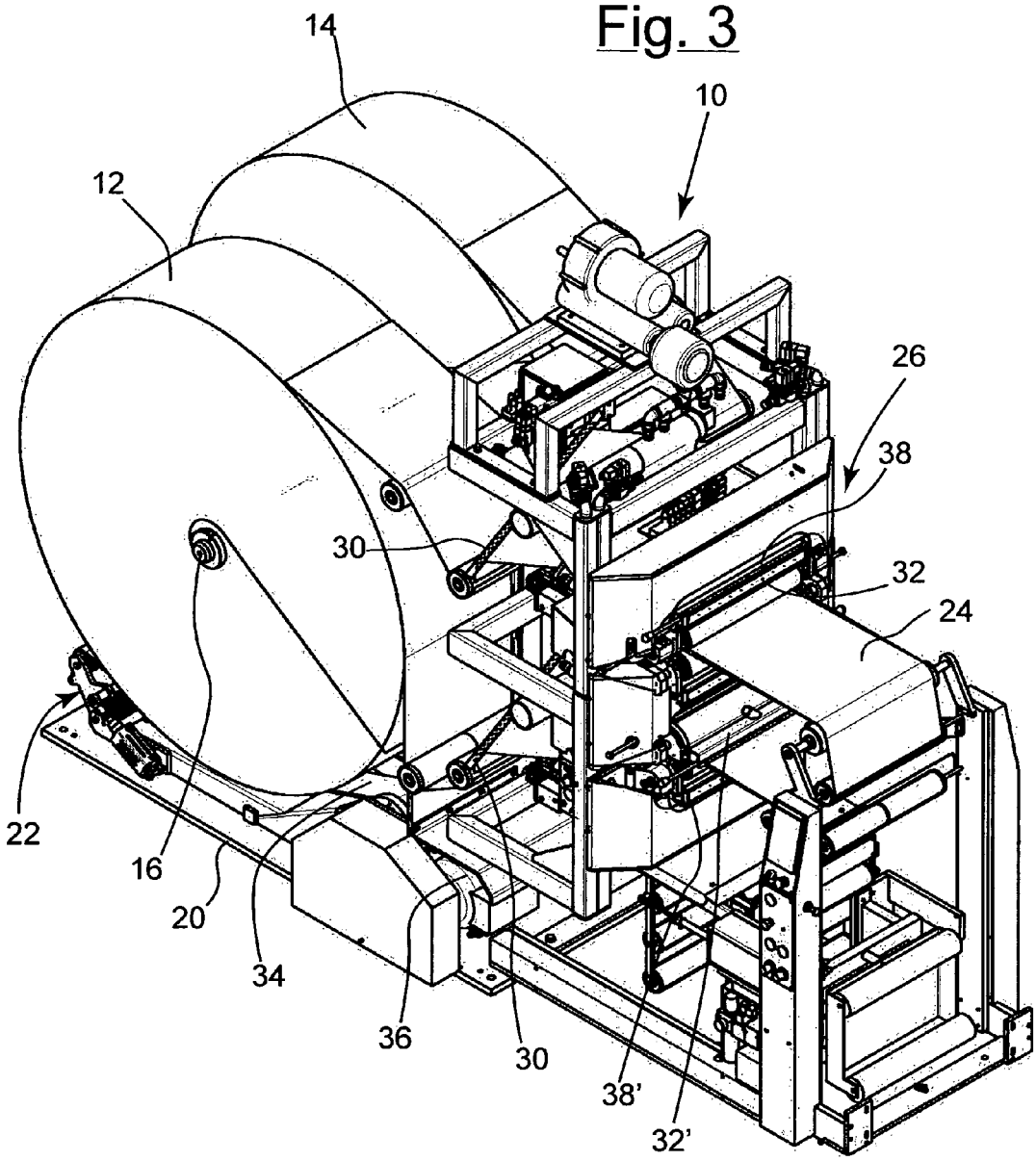
FIG. 3 is a perspective view, from the front side, of a second embodiment of an unwinding device with limited bulk for rolls of web-like material according to the present invention.
Figure 4:
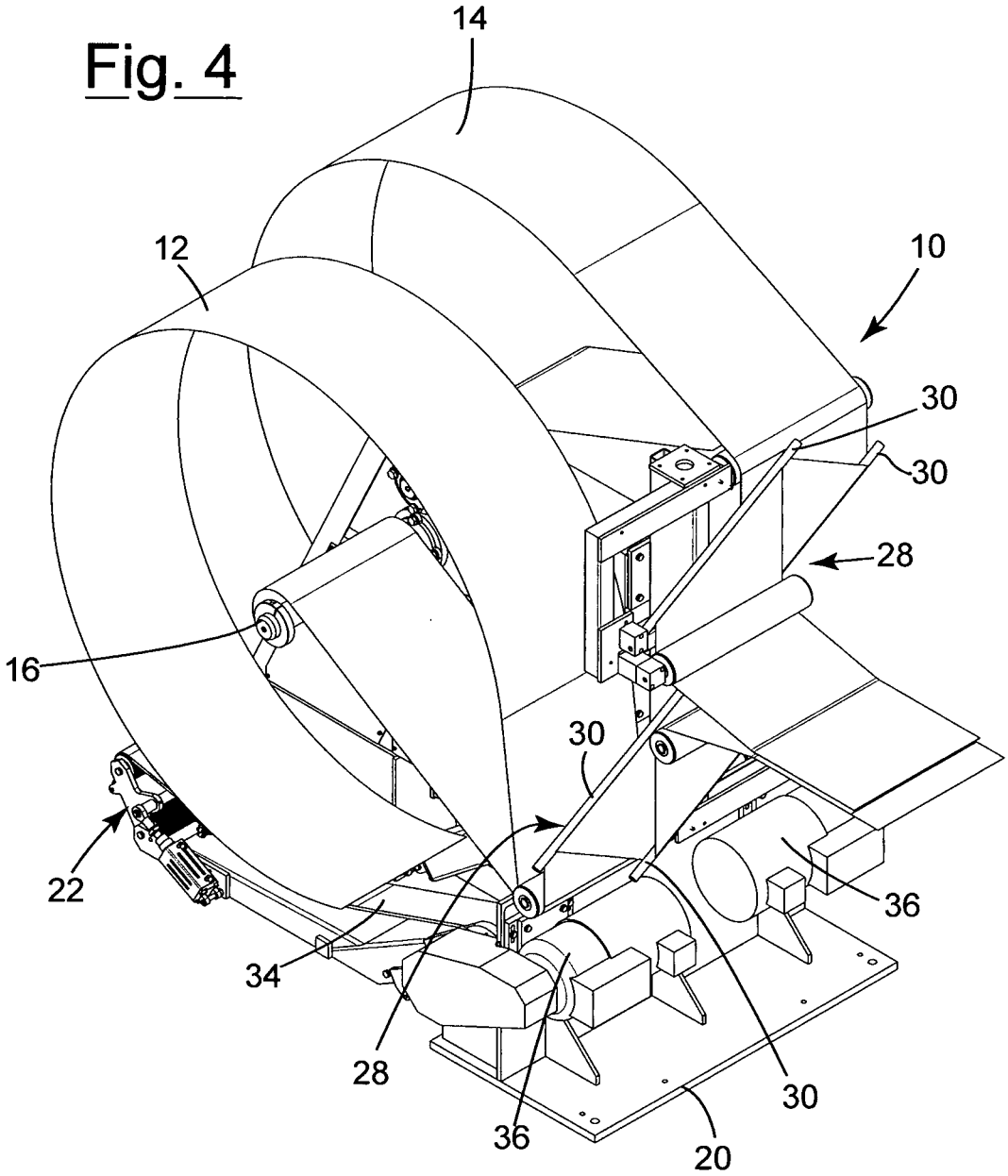
FIG. 4 is a perspective view, from the front side, of the unwinding device of FIG. 2, lacking the mechanism for joining the heads of the web-like material.
Figure 5:
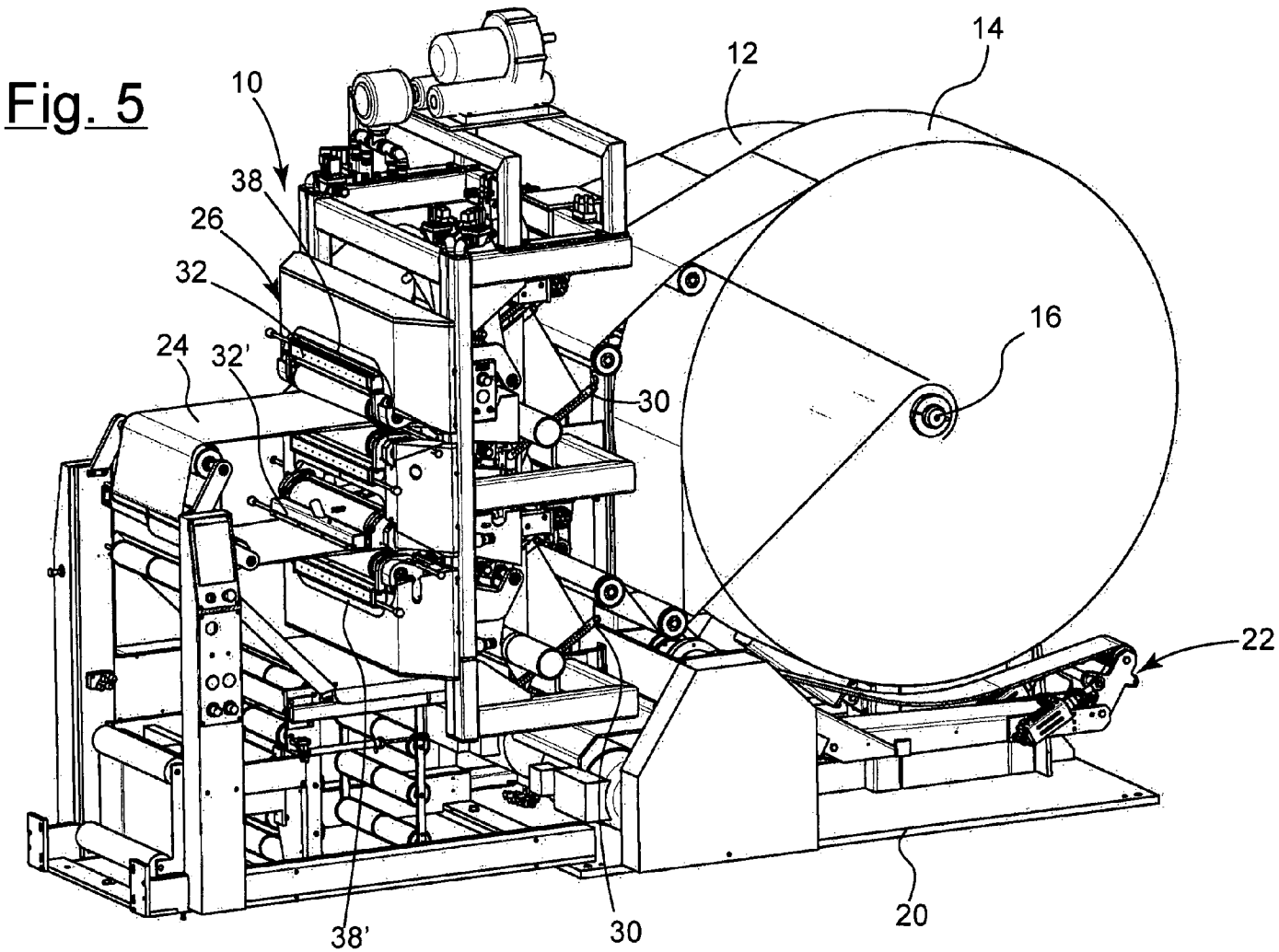
FIG. 5 is a perspective view, from the front side, of the unwinding device of FIG. 3.
Figure 6:
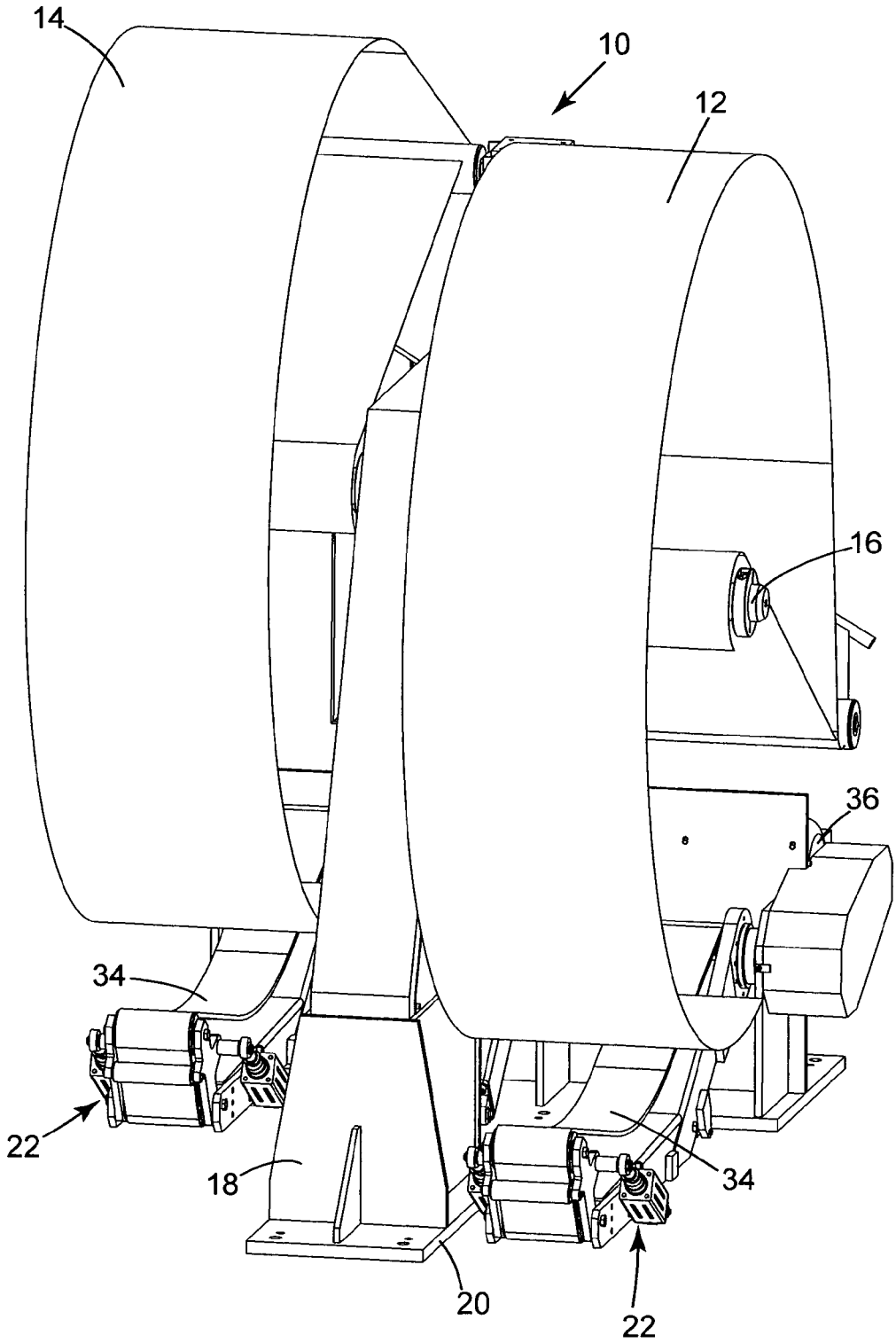
FIG. 6 is a perspective view, from the rear side, of the unwinding device of FIG. 2.
Figure 12:
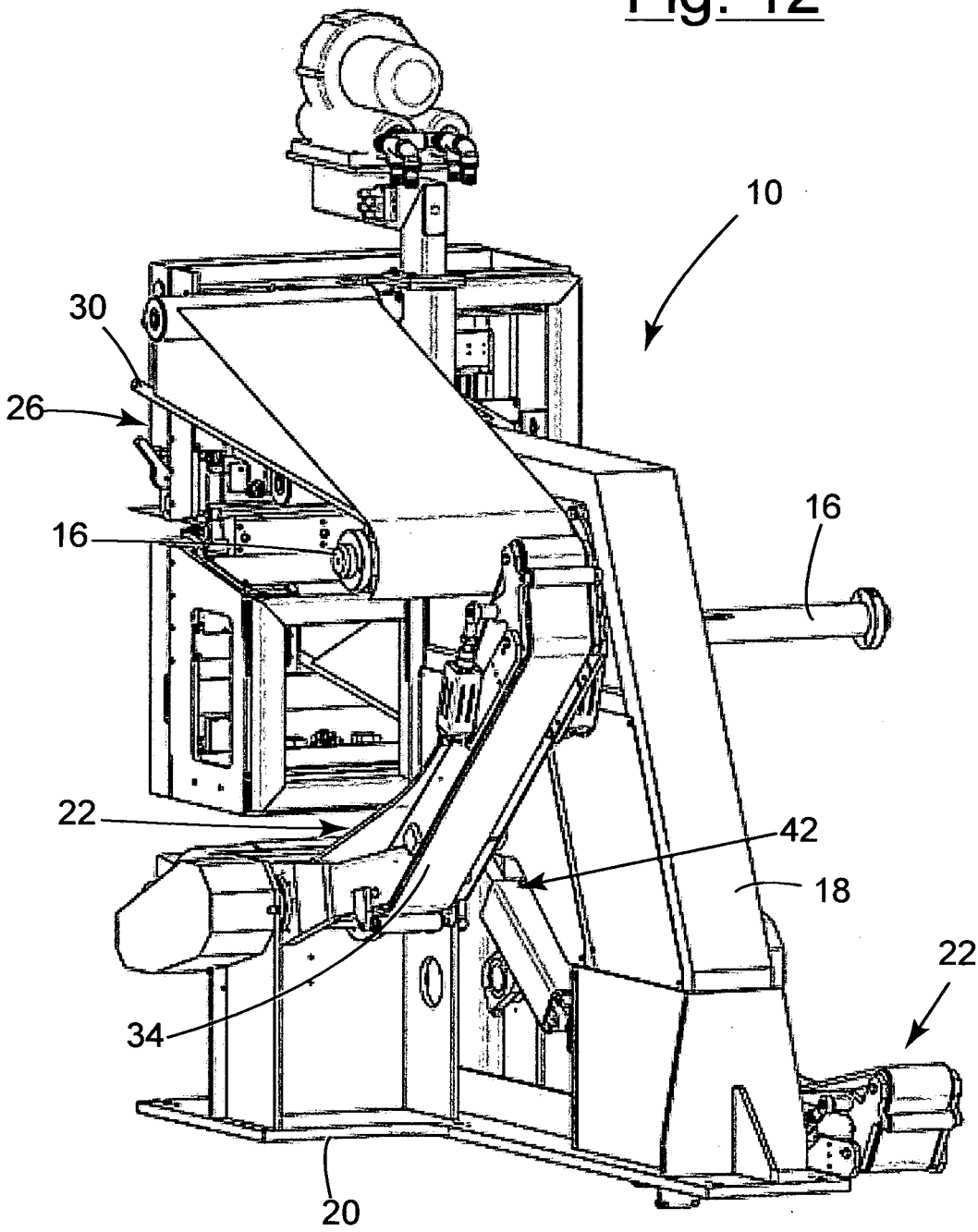
Figure 13:
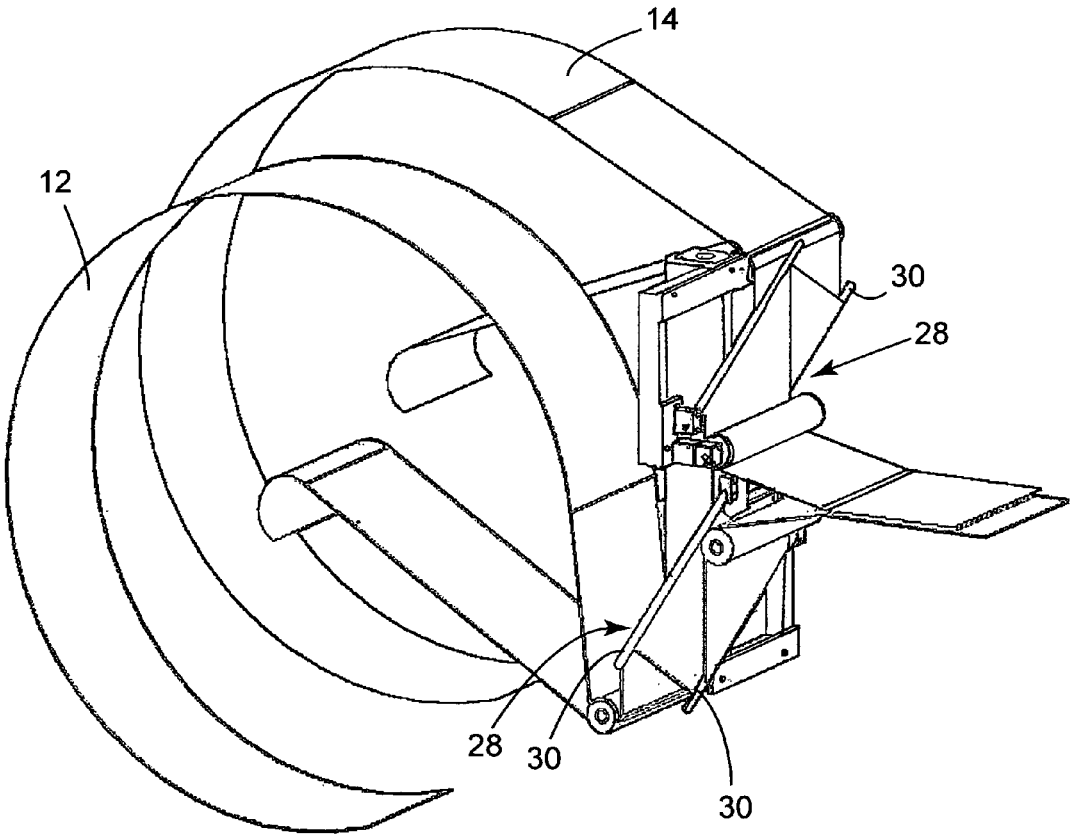

FIG. 12 is a further perspective view, from the rear side, of the unwinding device of FIG. 2, where the unwinding mechanisms of the web-like material are highlighted; and FIG. 13 is a schematic view which illustrates the step of joining the web-like materials coming from two flanking rolls mounted on an unwinding device with limited size for rolls of web-like material according to the present invention.

Figure 1:
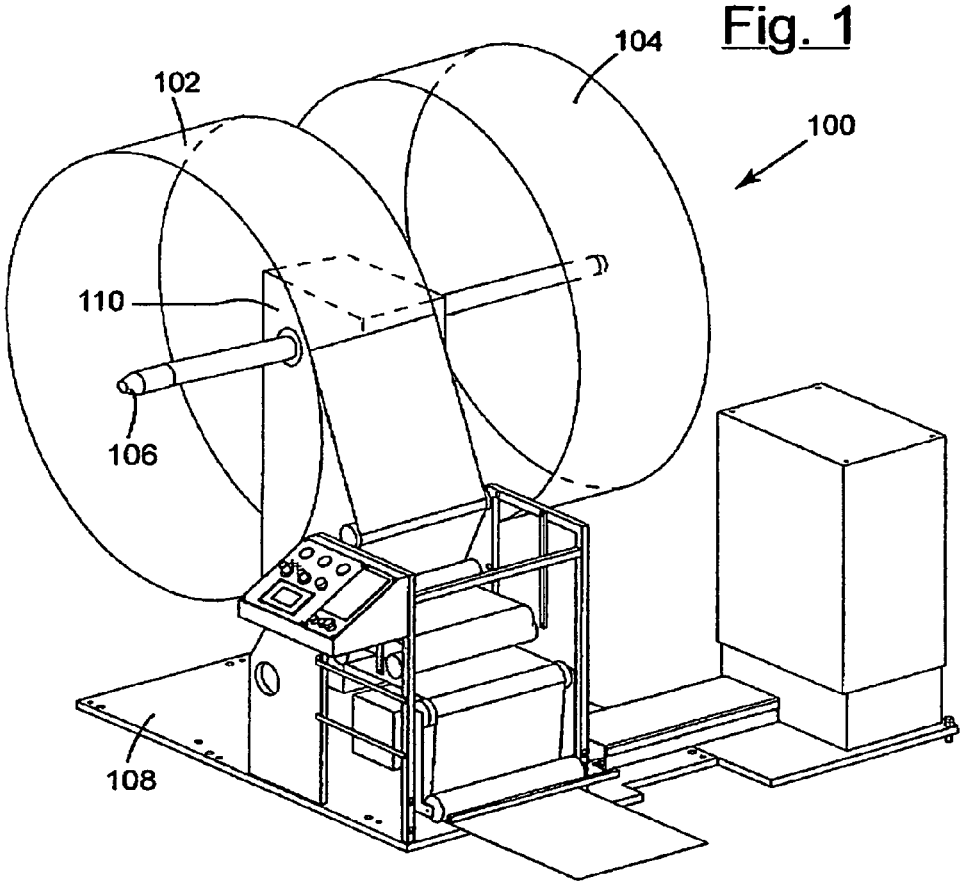
PRIOR ART Fig. 1
FIG. 1 is a perspective view of an unwinding device for rolls of web-like material according to the prior art.

With particular reference to FIG. 1, an unwinding device 100 is shown for rolls of web-like material according to the prior art. The two rolls 102 and 104 of web-like material are arranged flanking, mounted on horizontal support pins 106 placed at the same height, i.e. at the same vertical distance from the base 108 of the device 100. The support pins 106 are bound to a vertical column 110 provided with means (not shown) for carrying out the 180° rotation, around a vertical axis, of the rolls 102 and 104 and of the related support pins 106.

Therefore, when the web present on the roll 102 is close to finishing, it is necessary to completely stop the device 100, make the arm 110 rotate 180°, with consequent need to arrange a suitable surrounding space for carrying out such operation, and prearrange the new roll 104 for the subsequent web head joining step. Only at the end of such step can the operator reactivate the device 100.

With reference now to the FIGS. 2-13, two separate embodiments are shown of a non-stop unwinding device with limited bulk for rolls of web-like material according to the present invention, indicated overall with the reference number 10.

At least two rolls 12 and 14 of web-like material are supported on the device 10, arranged flanking in the longitudinal direction of the device 10. More precisely, the support group of the rolls 12 and 14 is composed of a support pin 16 for each roll 12 and 14, the support pins 16 being bound on two opposite sides of a vertical column 18 made integral with the base 20 of the unwinding device 10. The support pins 16 are horizontally extended, in a substantially orthogonal direction to a vertical plane passing through the longitudinal centre axis of the device 10.

The device 10 then comprises, for each of the rolls 12 and 14 to be unwound, an unwinding mechanism 22 adapted to unwind, from the related roll 12 or 14, the web-like material 24 which is normally composed of one sheet (FIG. 2, single ply rolls) or by two sheets (FIG. 3, two-ply rolls) of paper material, in order to send it to the processing machinery (not shown) placed downstream of the device 10.

Each unwinding mechanism 22 is composed, in the illustrated embodiment, by at least one continuous belt 34 placed below the related roll 12 or 14. A gearmotor group 36 maintains the continuous belt 34 in rotation and in contact with the back of the related roll 12 or 14 for facilitating the unwinding of the web-like material 24.

The device 10 also comprises a joining mechanism 26 set to join specific portions of web-like material respectively coming from the roll 12 completing unrolling and the roll 14 ready to begin unrolling.

Figure 7:
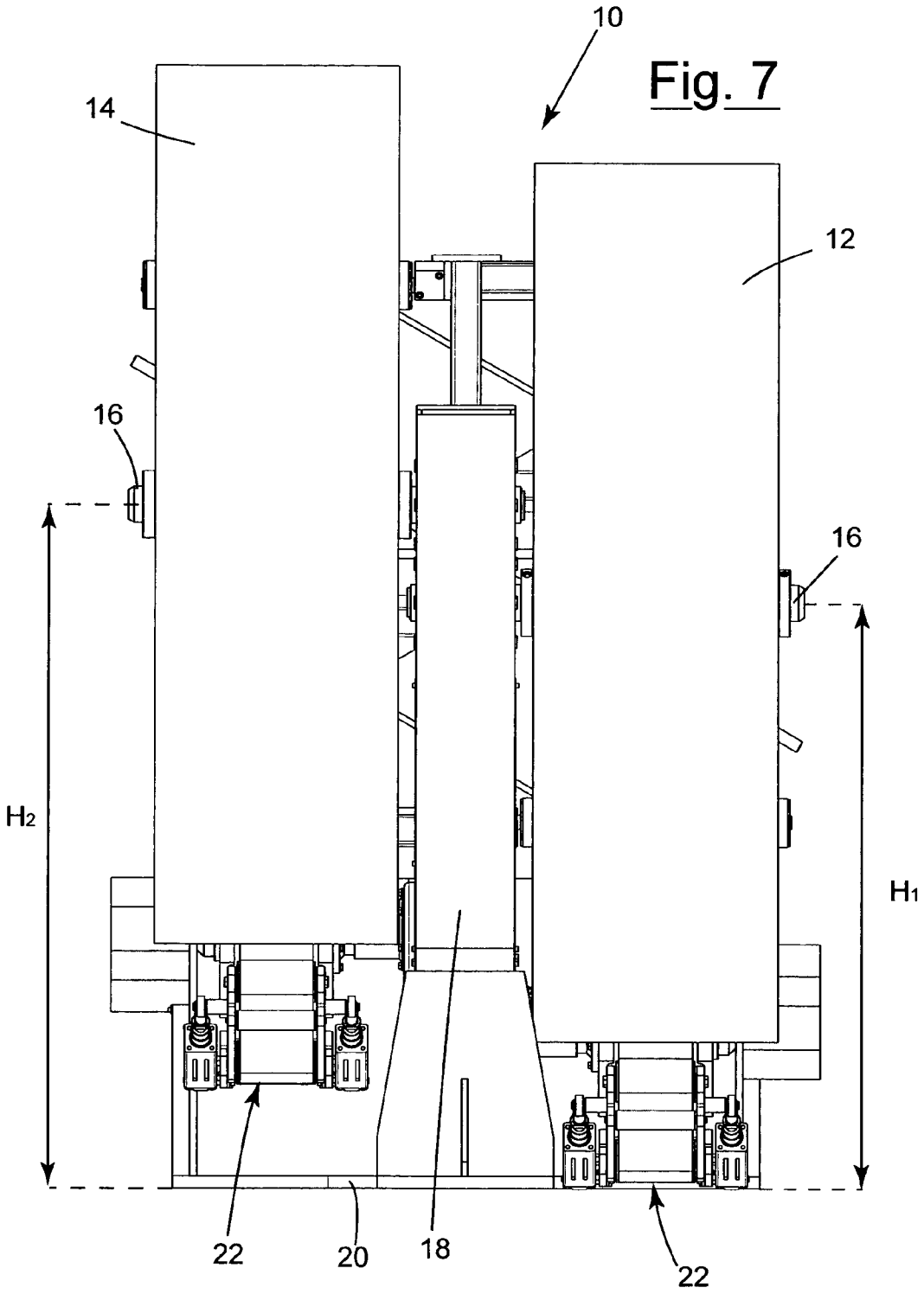
FIG. 7 is a side elevation view, from the rear side, of the unwinding device of FIG. 2.
Figure 8:
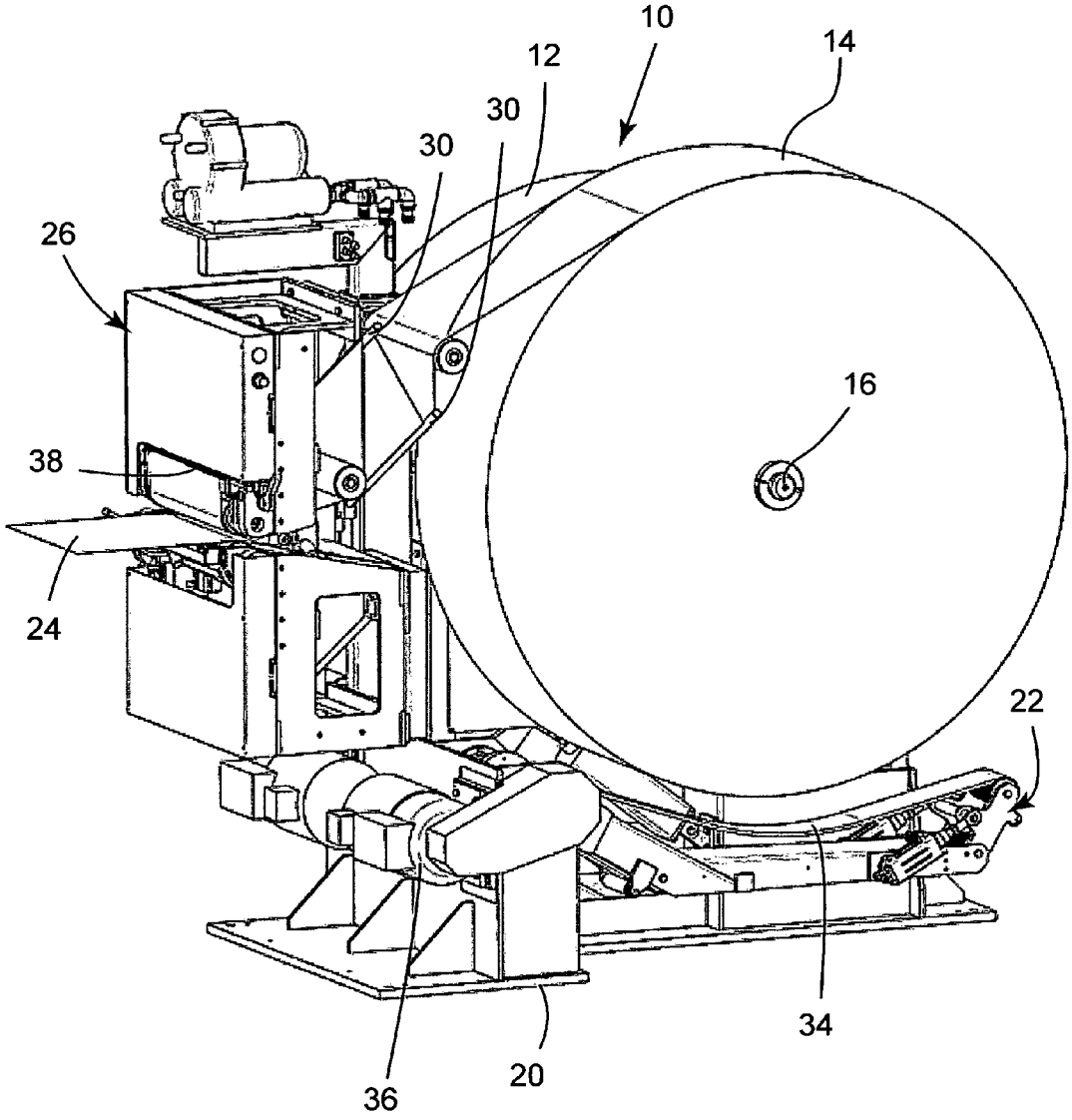
FIGS. 8 and 9 are further perspective views of the unwinding device of FIG. 2.
Figure 9:
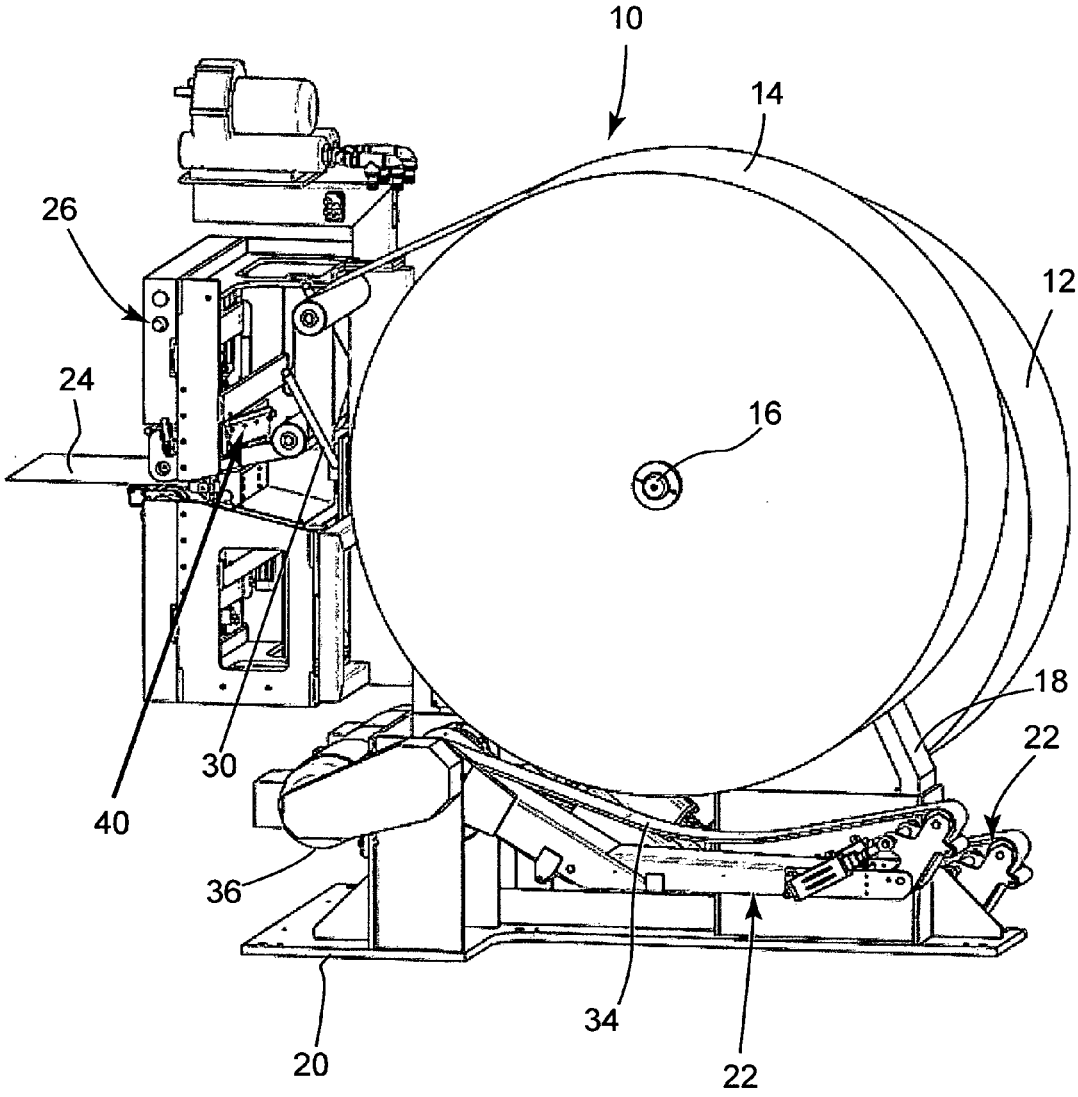
Figure 10:
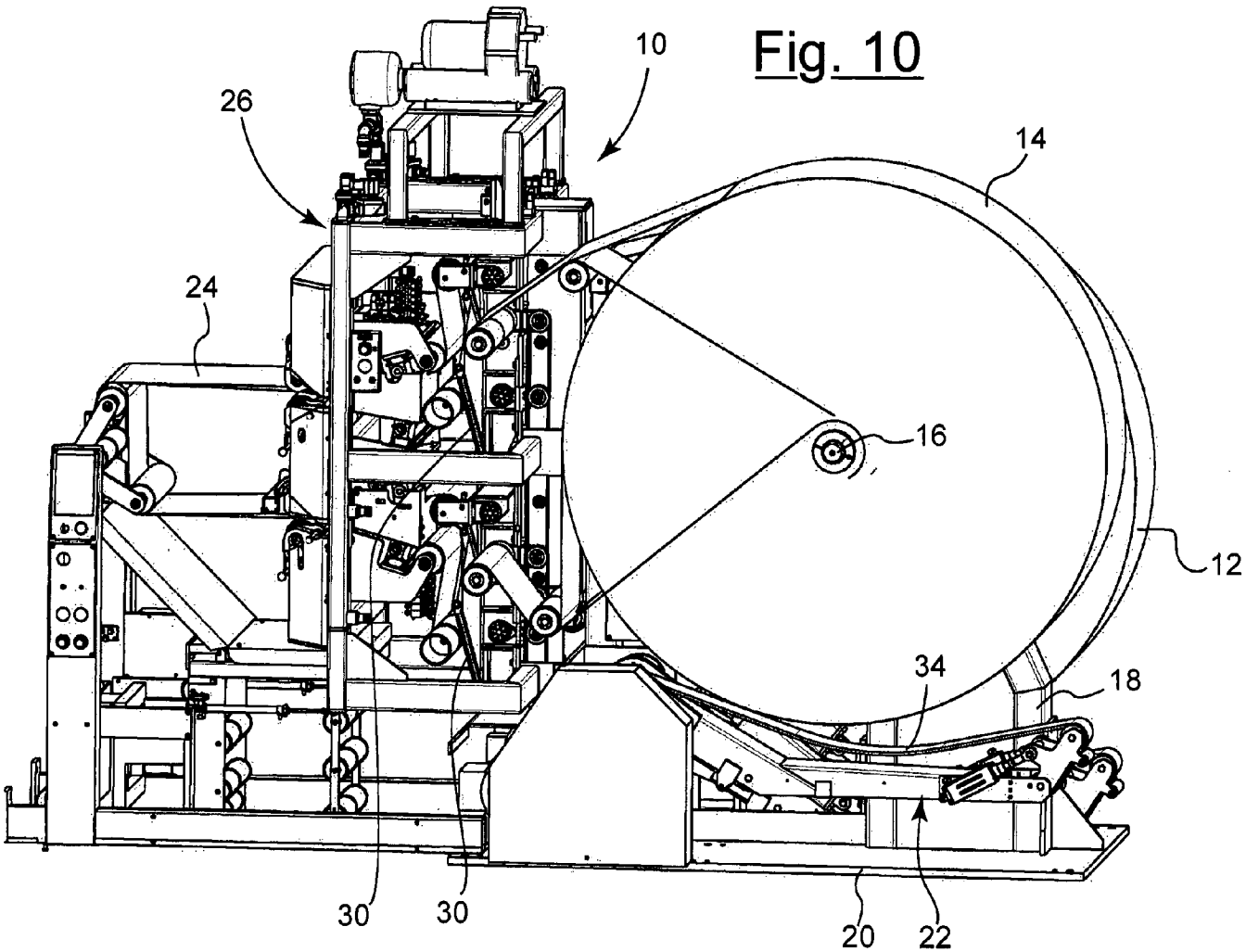
FIGS. 10 and 11 are further prospective views of the unwinding device of FIG. 3.
Figure 11:
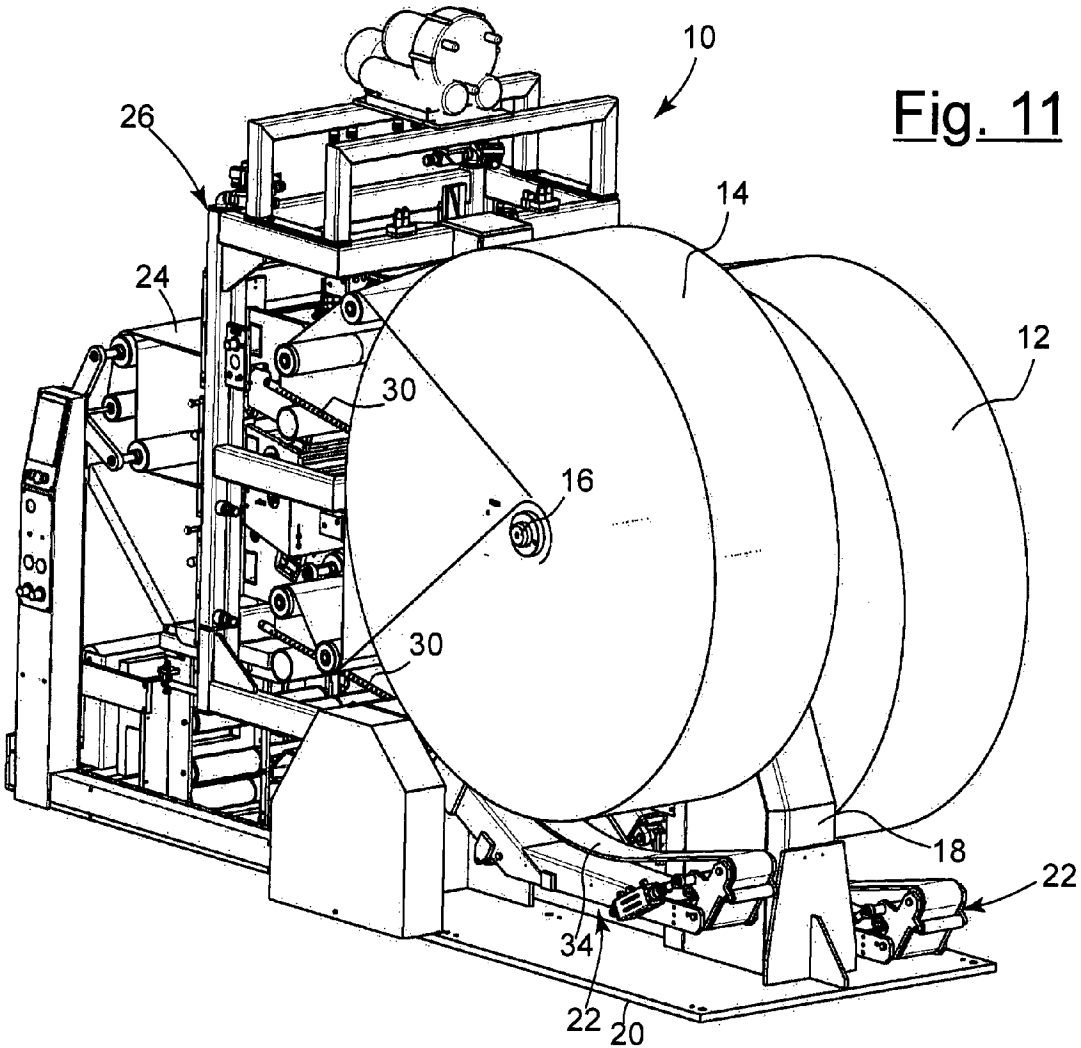

Advantageously, according to the present invention, the support pins 16 for the rolls 12 and 14 are bound to the vertical column 18 at different respective heights $H_1$ and $H_2$ with respect to the base 20 of the device 10 (FIG. 7). This permits reducing the transverse dimensions of the unwinding device 10 to a minimum, making a vertical column 18 of minimum width while ensuring a suitable support capacity for the rolls 12 and 14, normally of considerable size and weight. It is in fact possible to make on the vertical column 18—at different heights $H_1$ and $H_2$ and possibly also at different longitudinal distances from the web handling mechanisms 22 and 26—two separate through holes for the insertion and subsequent locking in place of the support pins 16, so as to not require the manufacture of a column of thickness such to be able to sustain support pins placed on the same axis and height.

In the illustrated embodiments, the joining mechanism 26 and the vertical column 18 are arranged in a central position, i.e. along the longitudinal centre axis of the unwinding device 10. Such longitudinal centre axis thus results equidistant from the two flanking rolls 12 and 14. Deflection means 28 are then provided downstream of each roller 12 and 14, each comprising return bars 30 tilted with respect to a horizontal plane in order to deflect the web-like material 24 coming from the rolls 12 and 14 and to direct it towards the joining mechanism 26 placed in a central position with respect to the device 10.

During the step of joining the webs on the unwinding device 10 according to the invention, the one-ply or two-ply web-like material 24 coming from one of the rolls 12 being processed, suitably guided by deflection means 28, crosses the joining mechanism 26 where the initial edge (or the two edges, if the roll is two-ply) of the new roll 14 waiting to be processed is retained on a joining pad 32 by means of a suction system 38. Double-sided adhesive tape is extended on such edge, which will paste it to the web exiting from the roll 12 completing unwinding. Normally, in a per se known manner, the junction zone of the web-like material 24 will then be discarded by the subsequent machinery in order to make the finished product.

If two-ply rolls 12 and 14 must be processed, the unwinding device 10 is provided with a joining mechanism 26 (FIGS. 3, 5, 10 and 11) comprising two separate joining pads 32 and 32', each having a respective suction system 38 and 38' for separately retaining the two edges of the roll 12 being processed. The retaining steps of the web entering the joining mechanism 26 are entirely similar to those provided for the single-ply rolls. Double-sided adhesive tape is extended on both edges of the roll which will paste every single ply to the respective single plies of the web exiting from the roll completing unwinding.

The sequence of the roll change is the following. When the roll 12 being processed has nearly reached the end, a sensor 42 (FIG. 12) signals such condition. The functioning speed of the unwinding device 10 is then automatically decreased, fixed at about 100 meters per minute. At this point, the joining pad or pads 32 and 32' are closed and are quickly reopened by pasting the edge or edges of web waiting to be processed with every single ply of the roll 12 completing processing. At the same time, a knife 40 (FIG. 9) cuts the end of the roll 12 that has by now reached the end and the device 10 can once again bring its operating speed back to a value close to that of production.

The roll change sequence described up to now can occur in a time equal to about 30 seconds, without having to stop the unwinding device 10. Once the change has occurred, the operator then has a lot of time available for preparing and loading a new roll in the machine, and such new roll's web-like material will later be connected with that of the roll being processed.

It is thus seen that the non-stop unwinding device with limited bulk for rolls of web-like material according to the present invention attains the objects highlighted above, allowing both the reduction of the overall bulk and a greater functioning speed and reliability of the device itself, without requiring stopping in the roll change step.

The non-stop unwinding device with limited bulk for rolls of web-like material according to the present invention thus conceived is in any case susceptible to numerous modifications and variants, all part of the same inventive concept; in addition, all the details can be substituted by technically equivalent elements, while the shapes and sizes can be of any type according to technical requirements.

The protective scope of the invention is therefore defined by the enclosed claims.

The invention claimed is:

1. An unwinding device (10) for unwinding rolls (12, 14) of one-ply or two-ply web-like material (24), the device (10) comprising: a support group for sustaining a first roll (12) and a second roll (14), said support group being composed of a support pin (16) for each roll (12, 14), said support pins (16) being bound on two opposite sides of a vertical column (18) made integral with the base (20) of said unwinding device (10); an unwinding mechanism (22) for each of said first roll (12) and second roll (14), adapted to unwind said web-like material (24) from said first roll (12) and second roll (14); said unwinding device also comprising deflection means (28) for deflecting said one-ply or two-ply web-like material (24), said deflection means being placed downstream of said first roll (12) and second roll (14), in order to deflect said web-like material (24) coming from said first roll (12) and second roll (14) and send it towards a joining mechanism (26) adapted to join together specific portions of said web-like material (24) respectively coming from said first roll (12) and second roll (14), said joining mechanism (26) being provided with at least one joining pad (32, 32') adapted to retain said web-like material (24) by means of one or more suction systems (38, 38'), characterised in that a first of said support pins (16) is bound to said vertical column (18) at a height ($H_1$), measured with respect to said base (20), that is different from the height ($H_2$), measured with respect to said base (20), of the second of said support pins (16) bound on the opposite side of said vertical column (18).

2. The unwinding device (10) according to claim 1, characterised in that said support pins (16) are extended horizontally and in a substantially orthogonal direction with respect to a vertical plane passing through the longitudinal centre axis of said unwinding device (10).

3. The unwinding device (10) according to claim 1, characterised in that said joining mechanism (26) and said vertical column (18) are arranged in a central position along the longitudinal centre axis of said unwinding device (10).

4. The unwinding device (10) according to claim 3, characterised in that said first roll (12) and said second roll (14) are arranged on said support pins (16) of said vertical column (18) in a manner such that they are equidistant from said longitudinal centre axis of said unwinding device (10).

5. The unwinding device (10) according to claim 1, characterised in that said deflection means (28) comprise one or more return bars (30) that are tilted with respect to a horizontal plane.

6. The unwinding device (10) according to claim 1, characterised in that each of said unwinding mechanisms (22) is composed of at least one continuous belt (34) positioned below each of said rolls (12, 14).

7. The unwinding device (10) according to claim 6, characterised in that said continuous belt (34) is placed in rotation and in contact with the back of each of said rolls (12, 14) by means of a gear motor group (36), in order to facilitate the unwinding of said web-like material (24).

8. The unwinding device (10) according to claim 7, further comprising at least one sensor (42) adapted to signal the completed unwinding of said web-like material (24) from each of said rolls (12, 14).

9. The unwinding device (10) according to claim 1, further comprising at least one knife (40) adapted to cut the end of said web-like material (24) unwound from one of said rolls (12, 14).

* * * * *